United States Patent [19]

Schwerdtfeger et al.

[11] 4,115,784

[45] Sep. 19, 1978

[54] DEPLOYABLE GROUND PLANE ANTENNA

[75] Inventors: Lee Schwerdtfeger, Silver Spring; Lee E. Stillman, Wheaton; William E. Frain, Ellicott City, all of Md.

[73] Assignee: The United States of America as represented by the Secretary of the Air Force, Washington, D.C.

[21] Appl. No.: 765,719

[22] Filed: Feb. 4, 1977

[51] Int. Cl.[2] ..... H01Q 15/20

[52] U.S. Cl. ..... 343/915; 343/DIG. 2; 350/289

[58] Field of Search ..... 350/288, 289; 343/DIG. 2, 915, 912, 881, 882, 705, 840

[56] References Cited

U.S. PATENT DOCUMENTS

| | | | |
|---|---|---|---|
| 3,618,111 | 11/1971 | Vaughan | 343/915 |
| 3,635,547 | 1/1972 | Rushing et al. | 343/915 |
| 3,707,720 | 12/1972 | Stachlin et al. | 343/915 |
| 3,715,760 | 2/1973 | Palmer | 343/915 |
| 4,030,102 | 6/1977 | Kaplan et al. | 343/DIG. 2 |

*Primary Examiner*—Alfred E. Smith
*Assistant Examiner*—David K. Moore
*Attorney, Agent, or Firm*—Joseph E. Rusz; Jacob N. Erlich

[57] ABSTRACT

A deployable ground plane antenna for use aboard a satellite or the like, with the antenna and erection mechanism being compactly stowable within the confines of a launch vehicle prior to and during launch thereof. After ejection of the satellite from the launch vehicle, the ground plane antenna self-deploys on removal of a single cable restraint. The mesh-like ground plane or reflector is pulled into a deployed planar configuration by flexible rods which carry the ground plane and which are spring-loaded to provide erection force.

7 Claims, 4 Drawing Figures

24
32
28
34
30
43
32
22
28
36
43
28
43
43
28
43
28
43
28

DEPLOYABLE GROUND PLANE ANTENNA

STATEMENT OF THE GOVERNMENT INTEREST

The invention described herein may be manufactured and used by or for the Government for governmental purposes without the payment of any royalty thereon.

BACKGROUND OF THE INVENTION

This invention relates generally to an antenna, and, more particularly to a deployable ground plane antenna which when not in use is maintained in a collapased configuration taking up relatively small space, and, which can be rapidly expanded into the operative or deployed position.

In present day space applications, a need exists to make everything which is to be carried aloft by a missile, such as the components of a satellite, as lightweight and compact as possible. Any decrease in the weight of a device carried aloft will necessarily result in a corresponding increase in the payload capacity of the missile. The space within a satellite is also limited, and, accordingly, it is desirable to have all devices contained in the satellite in as compact a shape as possible.

Most satellites now include at least one ground plane antenna. The ground plane antenna is generally made up of an antenna or energy radiator and a reflector which surrounds the antenna or radiator and serves as a ground plane to properly direct the signals to or from the antenna. In many such applications, the antenna is not always in use. Because of the large space occupied by the ground plane antenna and especially by the reflector it has been often deemed desirable to employ a ground plane antenna which can be collapased during its periods of non-use so that it occupies a minimum amount of space. However, difficulties have arisen in providing a reflector which will serve as an efficient ground plane during its utilization periods and which can be easily and completely collapased during the periods of non-use. Difficulty has also been experienced in providing light and compact apparatus which will efficiently fold the reflector when the antenna is not being utilized.

SUMMARY OF THE INVENTION

The instant invention sets forth a deployable ground plane antenna which overcomes the problems set forth in detail hereinbelow.

The ground plane antenna of this invention is generally attached to or forms part of the body of a satellite, although not limited thereto, and when deployed has a ground plane or reflector which lies in a fixed plane perpendicular to an RF antenna or radiator which forms a part thereof. The reflector or ground plane portion has a generally circular configuration when deployed, with the body being comprised of a conductive mesh-like fabric held in place by flexible rods. The rods extend radially from points spaced equidistantly about the periphery of a housing which is mounted on the body of a satellite or the like.

During the retracted or stowed position the rods of the ground plane antenna of this invention are held against the periphery of the housing by means of a cable attached to the outer ends of the rods and thereby maintains the ground plane in a collapsed position requiring a minimal amount of space. A plurality of erection mechanisms, in the form of spring actuated members, are utilized to expand the ground plane upon the severing or release of the cable by any conventional line cutting or severing mechanism. The erection force provided by the erection mechanisms is sufficient to erect all rods and therefore maintain the ground plane in its operable condition with respect to the RF antenna.

It is therefore an object of this invention to provide a deployable ground plane antenna which can be compactly stowed in the inoperable condition.

It is another object of this invention to provide a deployable ground plane antenna which is capable of being used in conjunction with a satellite and can be contained within the confines of the launch vehicle prior to launch of the satellite.

It is still another object of this invention to provide a deployable ground plane antenna which is capable of self deployment upon the removal of a single cable restraint.

It is still a further object of this invention to provide a deployable ground plane antenna which is economical to produce, reliable in operation and which utilizes conventional, currently available components in the manufacture thereof.

For a better understanding of the present invention together with other and further objects thereof reference is made to the following description taken in conjunction with the accompanying drawing and its scope will be pointed out in the appended claims.

DETAILED DESCRIPTION OF THE PREFERRED EMBODIMENT

Figure 1:
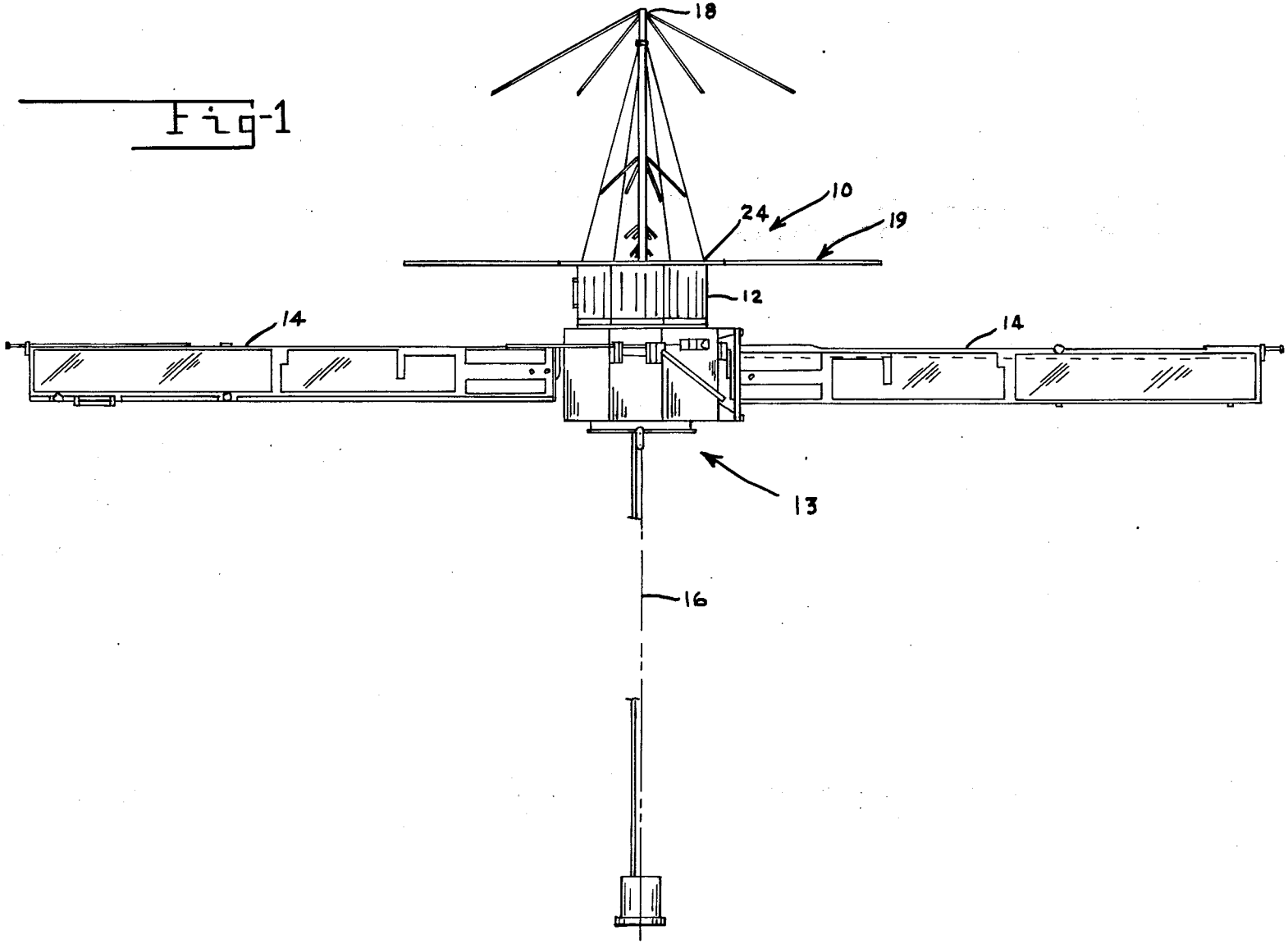
FIG. 1 is a side elevational view of the ground plane antenna of this invention utilized in conjunction with a satellite and shown in the deployed position.

Reference is now made to FIG. 1 of the drawings which best illustrates the ground plane antenna 10 of this invention in its attached position to the body 12 of a satellite 13. Although the instant invention finds its greatest utility in conjunction with a satellite 13, the ground plane antenna 10 may find use in any instance where a highly effective antenna is necessary which requires only a minimal amount of space when not in use. The satellite 13, shown in the drawing, is of conventional construction and generally comprises of solar panels 14, a stabilization system 16 and a ground plane antenna 10 having a ground plane 19 and centrally located RF antenna or radiator 18. As clearly shown in FIG. 1 of the drawing, when ground plane antenna 10 is in the deployed position the reflector or ground plane 19 thereof lies in a fixed plane perpendicular to antenna or radiator 18.

Figure 2:
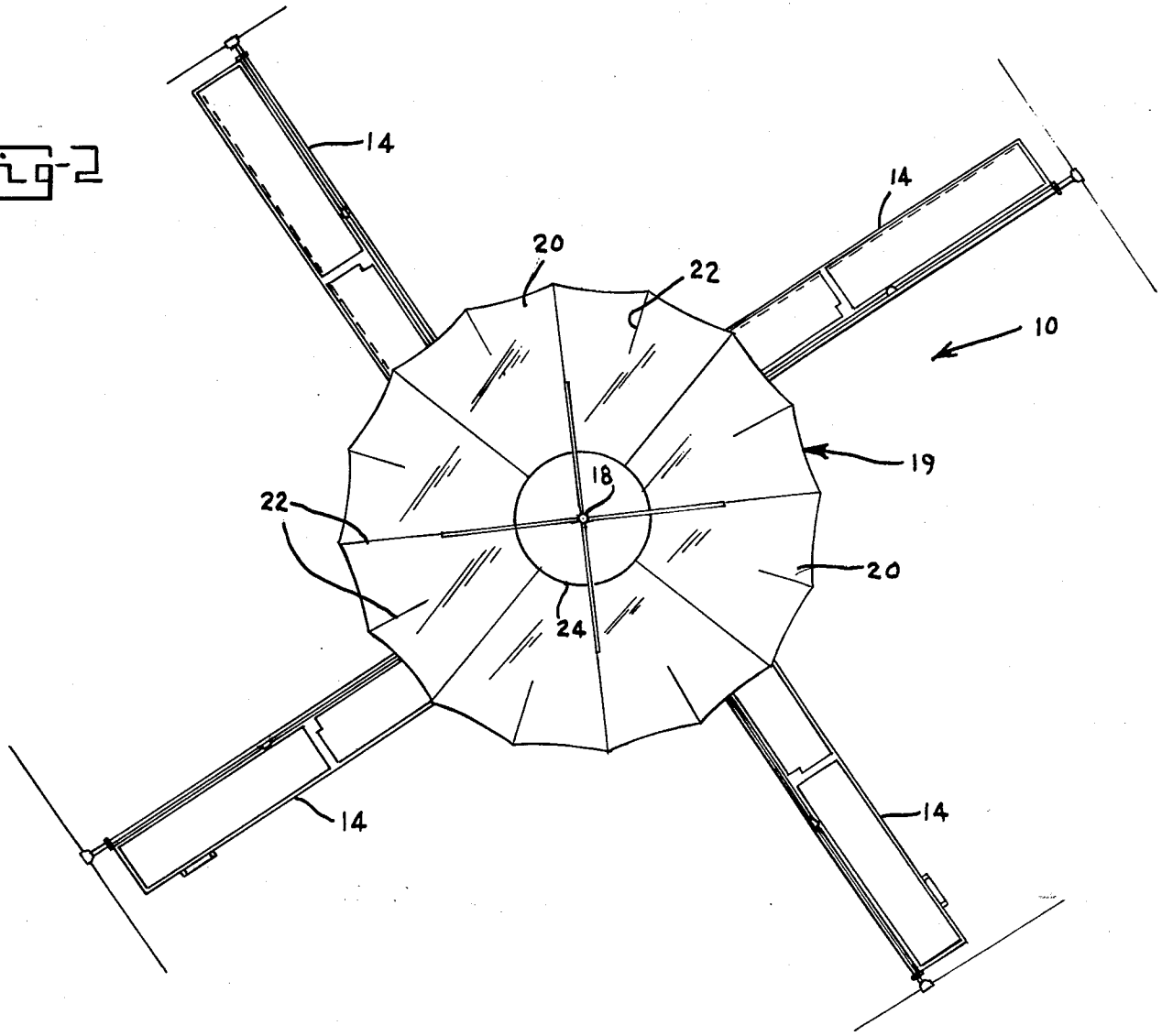
FIG. 2 is a top view of the ground plane antenna of this invention shown in the deployed position.

As best shown in FIG. 2 of the drawing, reflector or ground plane 19 generally has a circular configuration when deployed, with the body thereof being made up of any suitable conductive mesh-like fabric 20 secured to and held in position by a plurality of flexible rods 22. Rods 22 extend radially from points spaced equidistantly about the periphery of a housing 24 which is mounted in a conventional manner upon the body 12 of satellite 13.

Figure 3:
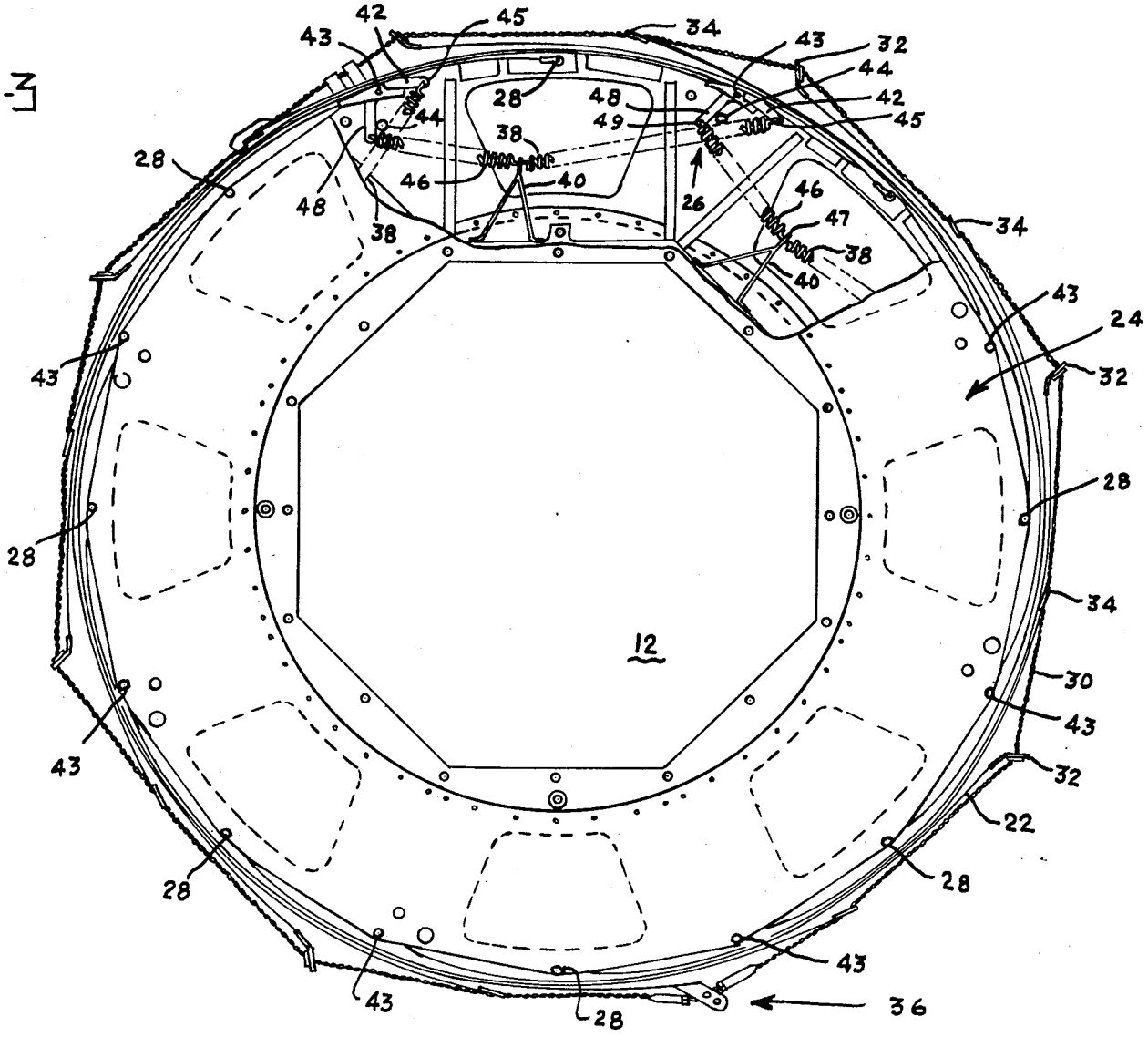
FIG. 3 is a top view of the housing of the ground plane antenna of this invention, showing in detail the ejection mechanisms.
Figure 4:
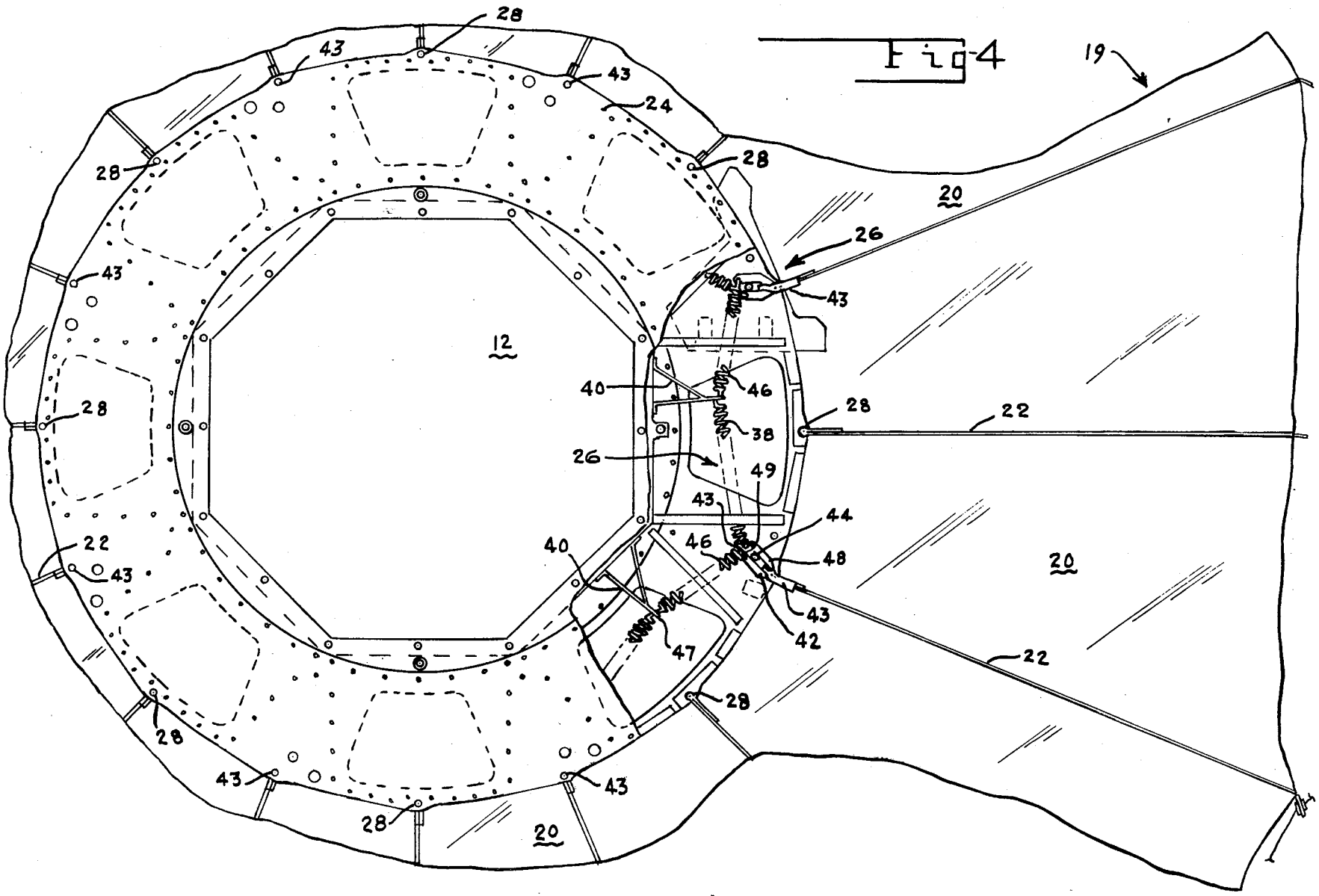
FIG. 4 is a top view of a portion of the ground plane antenna of this invention, with emphasis on the ejection mechanisms and showing the ground plane in its deployed position.

Housing 24, best seen in FIGS. 3 and 4 of the drawing, is of a substantially cylindrical configuration having a plurality of spring loaded erection mechanisms 26 mounted therein. One of the mechanisms 26 attaches to alternating rods 22 to provide an active errection force to rods 22 in a manner to be described in detail hereinbelow. Only one half the rods 22 are connected directly to an erection mechanism 26 while the remaining rods 22 are mounted by pivots 28 to the periphery of housing 24.

In the collapsed or stowed position, the reflector or ground plane 19 remains collapsed or folded against housing 24 (not shown) with rods 22 being held against the periphery of housing 24 by means of any suitable restraining device such as a cable which is threaded through angled eyelets 32 or the like located on the outer ends of those rods 22 which are connected to an erection mechanism 26. In addition, cable 30 is also threaded through flat eyelets 34 on the outer ends of passive rods 22. When the desired erection of ground plane 19 is to take place, cable 30 is severed by any conventional cutting mechanism 36, which can take the form of explosive bolts, etc., and is disposed either internally or externally of housing 24. Upon the severing of cable 30, rods 22 will then be erected by erection mechanisms 26 in a manner to be described below.

With reference still made to FIGS. 3 and 4 of the drawing, the erection mechanism 26 will now be described. Since the structure and operation of all of the erection mechanisms 26 are identical, only one such mechanism 26 will be described in detail. With ground plane 19 in the stowed or retracted position shown in FIG. 3 of the drawing, a coil spring 38 forming a major element of erection mechanism 26, is stretched between an interior mount 40, fixedly secured to the interior periphery of housing 24 and a member 42 which is pivotally mounted at 43 for pivotal movement about the outer periphery of housing 24. In addition, member 42 is attached to or formed as an integral part of the inner end 45 of a rod 22. When rod 22 is held against the periphery of housing 24 by cable 30 as shown in FIG. 3 of the drawing the longitudinal axis of pivoted member 42 lies substantially along a circle defined by the periphery of housing 24. On release of cable 30 by actuation of severing mechanism 36, spring 38 pulls the inner end 45 of member 42 toward the interior of housing 24 until the motion thereof is arrested by means of a detent pin 44 fixedly secured to housing 24. At the position at which motion of member 42 is arrested, rod 22 which is connected to member 42 becomes erected and extends radially (as shown in FIG. 4 of the drawing) from the housing 24. In this position rods 22 and ground plane 19 attached thereto are now disposed in the fully deployed position. A second spring 46 is mounted at one end 47 to mount 40 and at the other end 49 to a fixed or stationary member 48 which is held against the opposite side of pin 44 in order to provide a balancing force on mount 40 as well as on pin 44.

The erection force provided by erection mechanisms 26 which are attached to alternate rods 22 is of sufficient power to also erect those rods 22 which are merely mounted to the periphery of housing 24 by means of pivots 28. The erection force is transmitted to the passively mounted rods 22 by means of the mesh fabric 20 of ground plane 19. Upon complete erection of rods 22 ground plane 19 is now in the operational or deployed position as shown in FIGS. 1 and 4 of the drawing thereby acting as a ground plane or reflector for antenna or radiator 18.

Although this invention has been described with reference to a particular embodiment, it will be understood to those skilled in the art that this invention is also capable of a variety of alternate embodiments within the spirit and scope of the appended claims.

We claim:

1. A deployable ground plane antenna comprising a housing, said housing lying substantially within a single preselected plane, an antenna centrally located within said housing, said antenna having its longitudinal axis extending in a direction perpendicular to said preselected plane of said housing, a ground plane, said ground plane being made of collapsible material, means pivotally connected to said housing for supporting said ground plane in either a deployed condition radially extending from said housing or in a collapsed condition wrapped around said housing, said supporting means lying during said deployed conditions as well as said collapsed position substantially within said preselected plane of said housing, means operably connected to said supporting means for moving said supporting means and said ground plane between said collapsed position located adjacent to the periphery of said housing and wrapped therearound while lying substantially in said preselected plane of said housing and a deployed position extending radially beyond said housing while lying substantially within said preselected plane of said housing and means for maintaining said ground plane in the collapsed position whereby upon said release of said ground plane maintaining means said ground plane extends to said deployed position.

2. A deployable ground plane antenna as defined in claim 1 wherein said moving means is in the form of at least one erection mechanism, said erection mechanism comprising a mount fixedly secured to said housing, means interposed between said mount and said supporting means for biasing said ground plane to the deployed position, means for preventing the movement of said supporting means beyond a predetermined position and means for maintaining said mount and said movement prevention means in a fixed relationship with respect to said housing.

3. A deployable ground plane antenna as defined in claim 2 wherein said supporting means comprises a plurality of rods pivotally connected to said housing about an axis perpendicular to said preselected plane and at least one of said rods being operably connected to said erection mechanism.

4. A deployable ground plane antenna as defined in claim 3 wherein said biasing means is in the form of a spring.

5. A deployable ground plane antenna as defined in claim 4 wherein said mount and said movement prevention maintaining means is in the form of a member fixedly secured to said housing adjacent said movement prevention means and a spring interposed between said member and said mount.

6. A deployable ground plane antenna as defined in claim 5 wherein a preselected number of supporting rods are operatively connected to an erection mechanism.

7. A deployable ground plane antenna as defined in claim 6 wherein said ground plane is in the form of a conductive mesh-like fabric.

* * * * *